US007821465B2

(12) United States Patent
Rozan

(10) Patent No.: US 7,821,465 B2
(45) Date of Patent: Oct. 26, 2010

(54) MULTISERVICE ANTENNA SYSTEM ASSEMBLY

(75) Inventor: Edouard Jean Louis Rozan, Barcelona (ES)

(73) Assignee: A3-Advanced Automotive Antennas, Barcelona (ES)

( * ) Notice: Subject to any disclaimer, the term of this patent is extended or adjusted under 35 U.S.C. 154(b) by 732 days.

(21) Appl. No.: 11/571,463

(22) PCT Filed: Jun. 27, 2005

(86) PCT No.: PCT/EP2005/006896

§ 371 (c)(1),
(2), (4) Date: Jun. 1, 2007

(87) PCT Pub. No.: WO2006/002849

PCT Pub. Date: Jan. 12, 2006

(65) Prior Publication Data

US 2008/0018544 A1 Jan. 24, 2008

Related U.S. Application Data

(60) Provisional application No. 60/583,904, filed on Jun. 29, 2004.

(51) Int. Cl.
*H01Q 1/32* (2006.01)

(52) U.S. Cl. ..... 343/713; 343/700 MS

(58) Field of Classification Search ..... 343/700 MS, 343/713
See application file for complete search history.

(56) References Cited

U.S. PATENT DOCUMENTS

| | | | | |
|---|---|---|---|---|
| 6,019,475 | A | 2/2000 | Lynam et al. | |
| 6,285,331 | B1 * | 9/2001 | Jesman et al. | 343/713 |
| 6,433,749 | B1 | 8/2002 | Thompson | |
| 6,690,329 | B2 * | 2/2004 | Kodama | 343/713 |
| 2004/0119644 | A1 | 6/2004 | Puente-Baliarda et al. | |
| 2004/0196179 | A1 * | 10/2004 | Turnbull | 342/357.06 |
| 2004/0217916 | A1 * | 11/2004 | Quintero Illera et al. | 343/895 |

FOREIGN PATENT DOCUMENTS

| | | | |
|---|---|---|---|
| EP | 0-821-429 | A | 1/1998 |
| EP | 1-087-464 | A | 3/2001 |
| WO | WO 01/80353 | A | 10/2001 |
| WO | WO 2004/042868 | A | 5/2004 |

* cited by examiner

*Primary Examiner*—Douglas W Owens
*Assistant Examiner*—Dieu Hien T Duong
(74) *Attorney, Agent, or Firm*—Sughrue Mion, PLLC

(57) ABSTRACT

This invention relates generally to a multiservice antenna system assembly. The multiservice antenna system assembly may include one antenna that is fastened by means of a support, or at least two antennas that are grouped together by means of a support. The support may, for example, be a plastic packing. This invention is particularly useful when the antenna assembly is located in automobile rear-view mirrors and more particularly in exterior rear-view mirrors.

14 Claims, 14 Drawing Sheets a b a b a b

MULTISERVICE ANTENNA SYSTEM ASSEMBLY

This application claims priority from PCT Application No. PCT/EP2005/006896 filed Jun. 27, 2005, and from U.S. Provisional Patent Application No. 60/583,904 filed Jun. 29, 2004, which applications are incorporated herein by reference.

OBJECT AND BACKGROUND OF THE INVENTION

This invention relates generally to a multiservice antenna system assembly. The multiservice antenna system assembly may include one antenna that is fastened by means of a support, or at least two antennas that are grouped together by means of a support. The support may, for example, be a plastic packing. This invention is particularly useful when the antenna assembly is located in automobile rear-view mirrors and more particularly in exterior rear-view mirrors, but may also have utility in other applications.

Until recently, the telecommunication services included in an automobile were limited to a few systems, mainly the analogical radio reception (AM/FM bands). The most common solution for these systems is the typical whip antenna mounted on the car roof. The current tendency in the automotive sector is to reduce the aesthetic and aerodynamic impact of such whip antennas by embedding the antenna system in the vehicle structure. Also, a major integration of the several telecommunication services into a single antenna is specially attractive to reduce the manufacturing costs or the damages due to vandalism and car wash systems.

The antenna integration is becoming more and more necessary as we are assisting to a deep cultural change towards the information society. The internet has evoked an information age in which people around the globe expect, demand, and receive information. Car drivers expect to be able to drive safely while handling e-mail and telephone calls and obtaining directions, schedules, and other information accessible on the world wide web (WWW). Telematic devices can be used to automatically notify authorities of an accident and guide rescuers to the car, track stolen vehicles, provide navigation assistance to drivers, call emergency roadside assistance and remote diagnostics of engine functions.

The inclusion of advanced telecom equipments and services in cars an other motor vehicles is very recent, and it was first thought for top-level, luxury cars. However, the fast reduction in both equipment and service costs are bringing telematic products into mid-priced automobiles. The massive introduction of a wide range of such a new systems would generate a proliferation of antennas upon the bodywork of the car, in contradiction with the aesthetic and aerodynamic trends, unless an integrated solution for the antennas is used.

On the other hand FIG. 11 shows examples of space filling curves. Space filling curves 1501 through 1514 are examples of prior art space filling curves for antenna designs. Space filling curves fill the surface or volume where they are located in an efficient way while keeping the linear properties of being curves.

Among other possible definitions a Space-filling curve could be defined as a non-periodic curve composed by a number of connected straight segments smaller than a fraction of the operating free-space wave length, where the segments are arranged in such a way that none of said adjacent and connected segments form another longer straight segment and wherein none of said segments intersect to each other.

FIGS. 13-22 shows an example of how the grid dimension is calculated. The grid dimension of a curve (See FIG. 13) may be calculated as follows: A first grid (1700) having square cells of length L1 is positioned over the geometry of the curve such that the grid completely covers the curve. The number of cells (N1) in the first grid that enclose at least a portion of the curve are counted. Next, a second grid (1800) (FIG. 14) having square cells of length L2 is similarly positioned to completely cover the geometry of the curve, and the number of cells (N2) in the second grid that enclose at least a portion of the curve are counted. In addition, the first and second grids should be positioned within a minimum rectangular area enclosing the curve, such that no entire row or column on the perimeter of one of the grids fails to enclose at least a portion of the curve. The first grid preferably includes at least twenty-five cells, and the second grid preferably includes four times the number of cells as the first grid. Thus, the length (L2) of each square cell in the second grid should be one-half the length (L1) of each square cell in the first grid. The grid dimension (Dg) may then be calculated with the following equation:

$$D_g = -\frac{\log(N2) - \log(N1)}{\log(L2) - \log(L1)}.$$

For the purposes of this application, the term grid dimension curve is used to describe a curve geometry having a grid dimension that is greater than one (1). The larger the grid dimension, the higher the degree of miniaturization that may be achieved by the grid dimension curve in terms of an antenna operating at a specific frequency or wavelength. In addition, a grid dimension curve may, in some cases, also meet the requirements of a space-filling curve, as defined above. Therefore, for the purposes of this application a space-filling curve is one type of grid dimension curve.

FIG. 12 shows an example two-dimensional antenna (1600) forming a grid dimension curve with a grid dimension of approximately two (2). FIG. 13 shows the antenna (1600) of FIG. 12 enclosed in a first grid (1700) having thirty-two (32) square cells, each with a length L1. FIG. 14 shows the same antenna (1600) enclosed in a second grid (1800) having one hundred twenty-eight (128) square cells, each with a length L2. The length (L1) of each square cell in the first grid (1700) is twice the length (L2) of each square cell in the second grid (1800) (L2=2×L1). An examination of FIG. 14 and FIG. 15 reveal that at least a portion of the antenna (1600) is enclosed within every square cell in both the first and second grids (1700), (1800). Therefore, the value of N1 in the above grid dimension (Dg) equation is thirty-two (32) (i.e., the total number of cells in the first grid 801), and the value of N2 is one hundred twenty-eight (128) (i.e., the total number of cells in the second grid (802). Using the above equation, the grid dimension of the antenna 800 may be calculated as follows:

$$D_g = -\frac{\log(128) - \log(32)}{\log(2 \times L1) - \log(L1)} = 2$$

For a more accurate calculation of the grid dimension, the number of square cells may be increased up to a maximum amount. The maximum number of cells in a grid is dependant upon the resolution of the curve. As the number of cells approaches the maximum, the grid dimension calculation becomes more accurate. If a grid having more than the maximum number of cells is selected, however, then the accuracy of the grid dimension calculation begins to decrease. Typically, the maximum number of cells in a grid is one thousand (1000).

For example, FIG. 15 shows the same antenna 1600 enclosed in a third grid 1900 with five hundred twelve (512) square cells, each having a length L3. The length (L3) of the cells in the third grid 1900 is one half the length (L2) of the cells in the second grid 1800, shown in FIG. 18. As noted above, a portion of the antenna 1600 is enclosed within every square cell in the second grid 1800, thus the value of N for the second grid 1800 is one hundred twenty-eight (128). An examination of FIG. 8D, however, reveals that the antenna 800 is enclosed within only five hundred nine (509) of the five hundred twelve (512) cells of the third grid 1900. Therefore, the value of N for the third grid 1900 is five hundred nine (509). Using FIG. 8C and FIG. 8D, a more accurate value for the grid dimension (D) of the antenna 800 may be calculated as follows:

$$D_g = -\frac{\log(509) - \log(128)}{\log(2 \times L2) - \log(L2)} \approx 1.9915$$

FIGS. 16 and 17 shows an alternative example of how the box counting dimension is calculated. The antenna comprises a conducting pattern, at least a portion of which includes a curve, and the curve comprises at least five segments, each of the at least five segments forming an angle with each adjacent segment in the curve, at least three of the segments being shorter than one-tenth of the longest free-space operating wavelength of the antenna. Each angle between adjacent segments is less than 180° and at least two of the angles between adjacent sections are less than 115°, and wherein at least two of the angles are not equal. The curve fits inside a rectangular area, the longest side of the rectangular area being shorter than one-fifth of the longest free-space operating wavelength of the antenna.

One aspect of the present invention is the box-counting dimension of the curve that forms at least a portion of the antenna. For a given geometry lying on a surface, the box-counting dimension is computed in the following way: First a grid with boxes of size L1 is placed over the geometry, such that the grid completely covers the geometry, and the number of boxes N1 that include at least a point of the geometry are counted; secondly a grid with boxes of size L2 (L2 being smaller than L1) is also placed over the geometry, such that the grid completely covers the geometry, and the number of boxes N2 that include at least a point of the geometry are counted again. The box-counting dimension D is then computed as:

$$D = -\frac{\log(N2) - \log(N1)}{\log(L2) - \log(L1)}$$

In terms of the present invention, the box-counting dimension is computed by placing the first and second grids inside the minimum rectangular area enclosing the curve of the antenna and applying the above algorithm.

The first grid should be chosen such that the rectangular area is meshed in an array of at least 5×5 boxes or cells, and the second grid is chosen such that L2=½ L and such that the second grid includes at least 10×10 boxes. By the minimum rectangular area it will be understood such area wherein there is not an entire row or column on the perimeter of the grid that does not contain any piece of the curve. Thus, some of the embodiments of the present invention will feature a box-counting dimension larger than 1.17, and in those applications where the required degree of miniaturization is higher, the designs will feature a box-counting dimension ranging from 1.5 up to 3, inclusive. For some embodiments, a curve having a box-counting dimension of about 2 is preferred. For very small antennas, that fit for example in a rectangle of maximum size equal to one-twentieth of the longest free-space operating wavelength of the antenna, the box-counting dimension will be necessarily computed with a finer grid. In those cases, the first grid will be taken as a mesh of 10×10 equal cells, while the second grid will be taken as a mesh of 20×20 equal cells, and then D is computed according to the equation above. In the case of small packages with of planar designs, i.e., designs where the antenna is arranged in a single layer on a package substrate, it is preferred that the dimension of the curve included in the antenna geometry have a value close to D=2.

In general, for a given resonant frequency of the antenna, the larger the box-counting dimension the higher the degree of miniaturization that will be achieved by the antenna. One way of enhancing the miniaturization capabilities of the antenna according to the present invention is to arrange the several segments of the curve of the antenna pattern in such a way that the curve intersects at least one point of at least 14 boxes of the first grid with 5×5 boxes or cells enclosing the curve. Also, in other embodiments where a high degree of miniaturization is required, the curve crosses at least one of the boxes twice within the 5×5 grid, that is, the curve includes two non-adjacent portions inside at least one of the cells or boxes of the grid.

The placement of a multiservice antenna system in certain position of the vehicle, such as a exterior rearview mirror is advantageous for many reasons. For example, reception and transmission of the signal is improved. In addition the antenna may be delivered to the car manufacturer already mounted meanwhile the antenna remains hidden in order to enhance the aesthetic of the vehicle.

Certain parts of the vehicle must endure difficult mechanical conditions such as vibration, moisture environments and difficult grounding of electrical components. The multiservice antenna system disclosed herein may help to overcome problems associated with placement of a multiservice antenna system assembly in difficult environments either because mounting difficulties and/or extreme physical conditions such as vibration or moisture. For example, the following features may be included in a multiservice antenna system which help to overcome problems associated with mounting the antenna in difficult environments:

- integration of the radio AM/FM antenna and the related active system of the same physical support (FR4 in this case),
- the design of a plastic part to ensure waterproof protection of the active system components, fixation and position of the antennas respect to the other parts of the mirrors, ensure no damage during the part handlings,
- an adequate grounding of the different antennas integrated in the mirror to optimize the antenna performance and reduce the interference noise due to other devices,
- a correct separation and position in the same plane between the radio and telephone antennas, and
- the capacity to integrate 3 antennas services into the same external mirror One aspect of the invention refers to a multiservice antenna system assembly, which comprises at least one antenna wherein each antenna is supported by a support member.

At least one antenna of the assembly is placed on a face of a printed circuit board which is fixed to said support member. Preferably, said printed circuit board is at least partially embedded within said support member.

At least one antenna of the antenna system assembly is at least partially shaped as a space-filling curve or a grid-dimension curve, which preferably features a box-counting dimension or a grid dimension larger than 1.5, or larger than 1.9.

The multiservice antenna system assembly, provides radio communication services, telephone communication services, GPS positioning service, or any combination of said services. For that purpose, the antenna assembly may comprises a second printed circuit board including a telephone antenna, which is supported on said support member and is placed perpendicularly with respect to said first printed circuit board. Preferably, said telephone antenna is a GSM dual band antenna or a multiband antenna for cellular telephony.

Other aspect of the invention refers to a rear-view mirror assembly for a vehicle, which is conventionally formed by one or two mirrors attached to a protective case. The mirror assembly includes the multiservice antenna system assembly object of the present invention.

BRIEF DESCRIPTION OF THE DRAWINGS

To complete the description and in order to provide for a better understanding of the invention, a set of drawings is provided. Said drawings form an integral part of the description and illustrate a preferred embodiment of the invention, which should not be interpreted as restricting the scope of the invention, but just as an example of how the invention can be embodied. The drawings comprise the following figures.

DESCRIPTION OF A PREFERRED EMBODIMENT OF THE INVENTION

Figure 1:
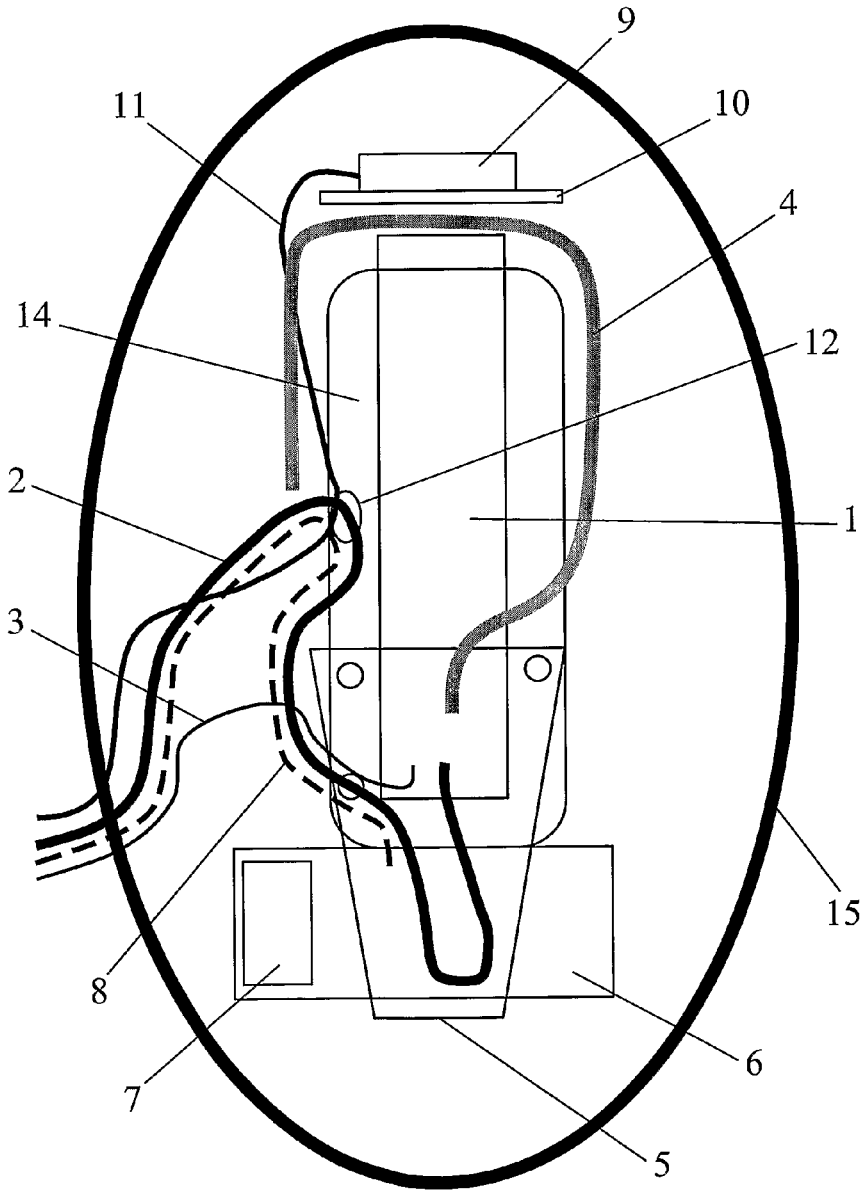
FIG. 1 shows a schematic front view of a rear-view mirror assembly object of the invention.

FIG. 1 shows a schematic view of an example multiservice antenna system assembly integrated inside a mirror assembly (15). The multiservice antenna system assembly includes a first PCB (printed Circuit Board) (1) including a space-filling or grid-dimension curve (1501-1514) based antenna design and an active system (13) formed by a radio frequency circuit and related feeding protection components. Preferably, the antenna geometry will include a Hilbert curve based design, or at least a curve with a box-counting dimension or grid dimension larger than 1.5. In general, the higher the box-counting or grid dimension, the higher the antenna size compression. In some cases, an antenna including a curve with a dimension larger than 1.9 will be preferred.

Preferably, the first printed circuit board (1) supports both the space-filling curve (1501-1514) and the related active system (13). It may be found in other cases that these two elements are separated. In the proposed example, the space filling or grid-dimension curve is optimized for FM reception.

The multiservice antenna system assembly further comprises a radio output coaxial cable (2), a radio DC feeding cable (3) to be connected to vehicle radio output, an antenna cable (4) designed for LW and MW reception optimization, a support member (5) consisting in a plastic packaging designed to support the radio antenna PCB inside the mirror and to ensure waterproof protection. This support member (5) is mounted on a plastic or metallic internal bracket (14). Alternatively, the support member (5) could be mounted on other inner part of the mirror assembly, different than the internal bracket (14), In a preferred embodiment, the support member (5) is provided only with the radio antenna. However, in other embodiment the multiservice antenna system assembly may also incorporates a Sub-assembly Cellular Telephony which comprises a Telephone antenna on a second printed circuit board (6), which is supported by the same molded packaging, that is the support member (5), that support the radio antenna.

In some cases, the same PCB may support both the support the space-filling or grid dimension antenna and the related the active system and the telephone antenna PCB.

The sub-assembly Cellular Telephony further comprises a GSM dual band telephone antenna (7) (copper metallic layer and plastic support), or alternatively, a multiband antenna for cellular telephony, and a telephone output coaxial cable (8).

The multiservice antenna system assembly, may be provided with a Sub-assembly GPS, comprising a GPS antenna (9), a GPS metallic support (10) to optimize antenna performance, and a GPS output coaxial cable (11).

All the output coaxial cables should be grounded to a metal part (12) inside the mirror assembly that is connected to the bodywork of a vehicle, for instance a car, to avoid interferences in AM (LW and MW) bands. Preferably, such a metal part (12) will be the internal bracket (14) of the mirror assembly (15).

Preferably, the operations for the antenna mounting inside the mirror and the cable routing are highly controlled in order to avoid any performance degradation. For this and other purposes, a specific plastic part, that is the support member (5) has been designed.

Figure 2:
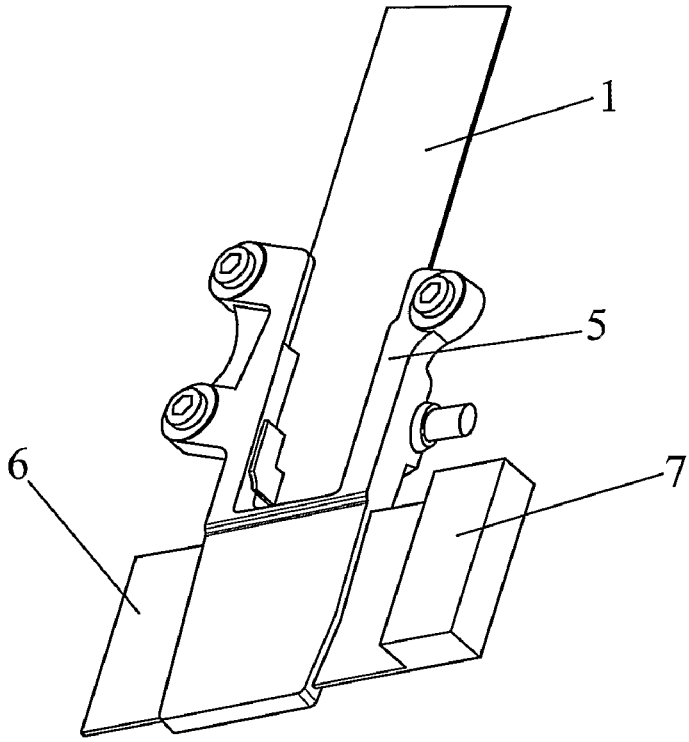
FIG. 2 shows a perspective view of the multiservice antenna system assembly of the invention.

Referring now to FIG. 2, the support member (5) is a plastic packaging designed to support the radio antenna supported on one face of the first PCB (1) inside the mirror assembly (15)

and to ensure waterproof protection. This packaging could be as a way of example made of ABS plastic or other plastic materials. The injection technique used for its manufacturing may be conventional injection or overmolded injection. Example functions provided by this plastic packaging include:

Waterproof protection to the electronic components

Protection from handling in mirror assembly line

Fixing structure of the antennas on the mirror bracket

Ensure the correct telephone and Radio antenna PCBs positioning respect to the other mirror parts Ensure the correct telephone antenna positioning respect to the radio antenna.

Give roughness to the cables soldered on the PCBs.

Ensure the RF coaxial routing of the Radio and Telephone antenna in the mirror to avoid antenna parameters deviation and interferences.

Figure 10:
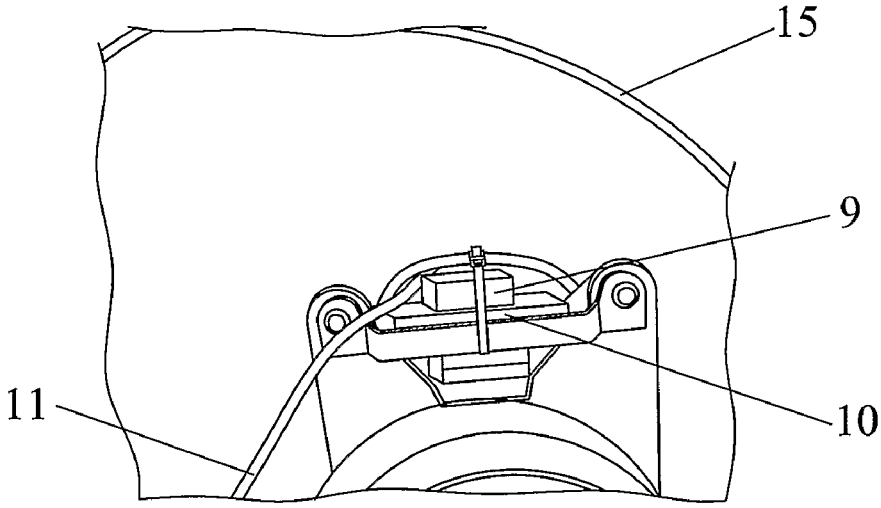
FIG. 10 shows a front view of the GPS antenna mounted inside a rear view mirror assembly.
Figure 10:
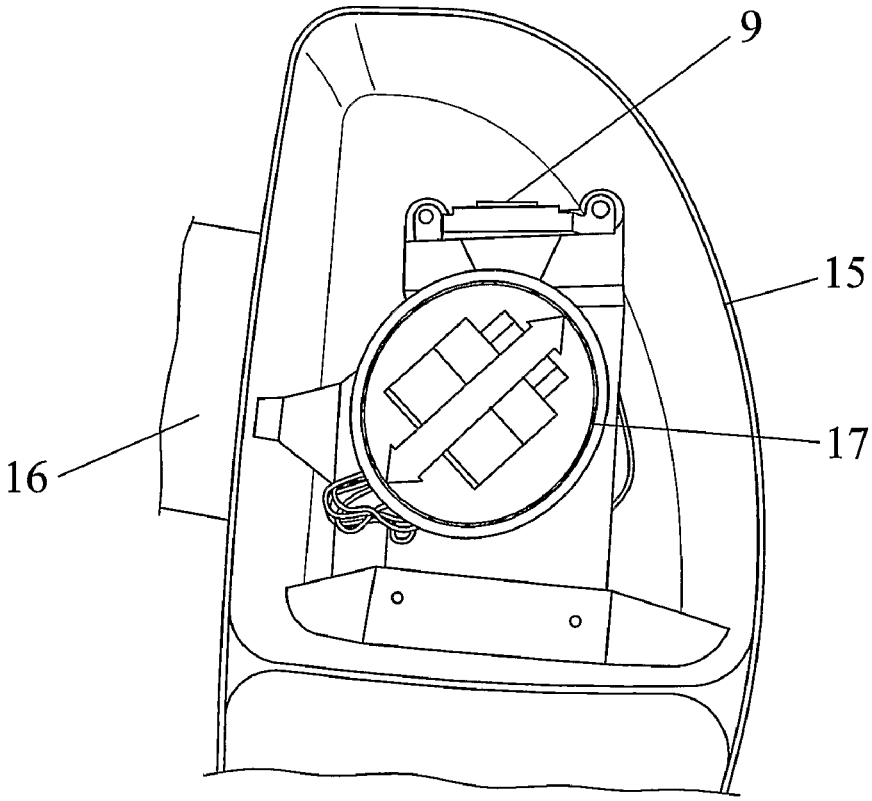
Figure 11:
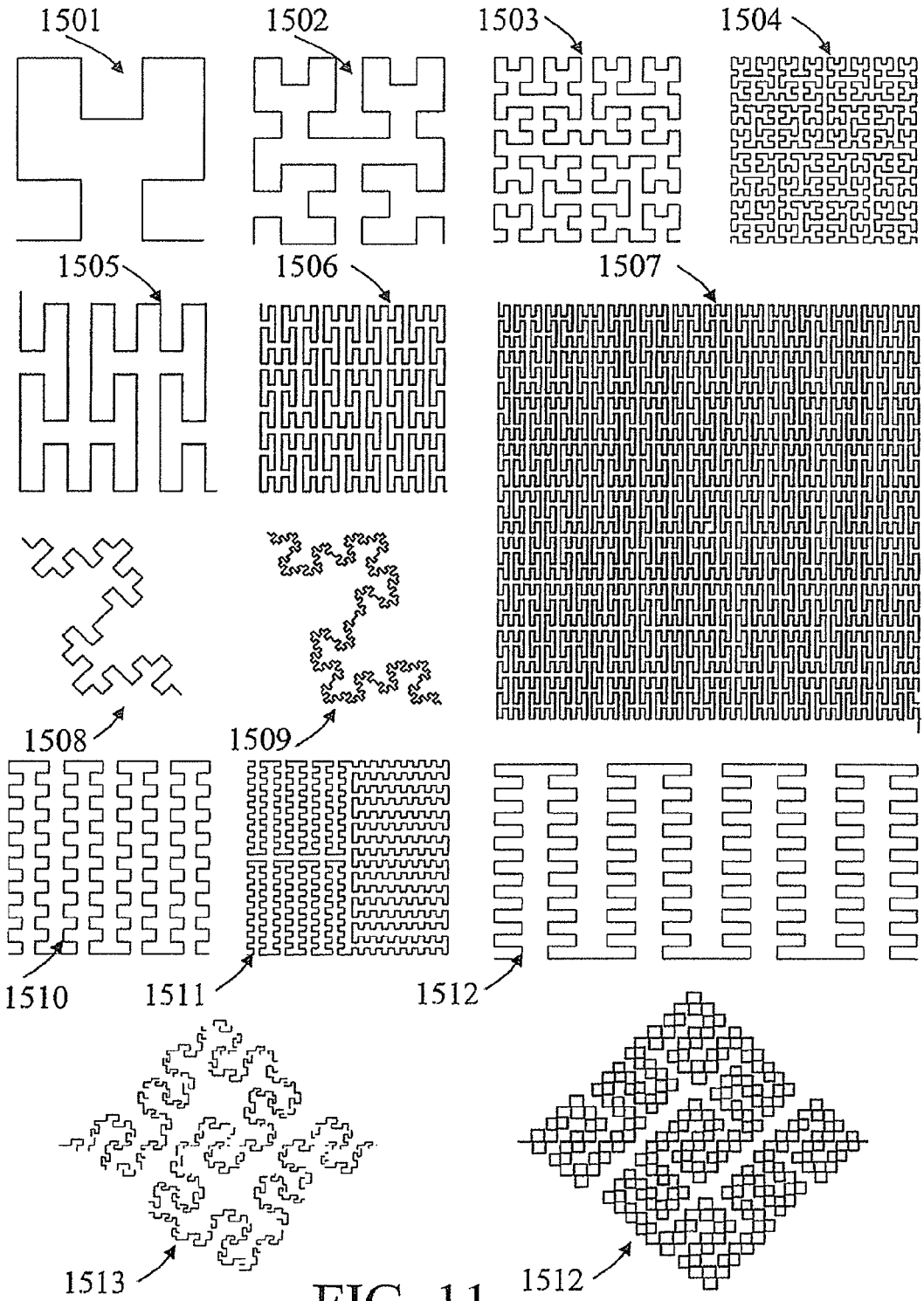
FIG. 11 shows examples of space-filling curves known in the prior-art.
Figure 12:
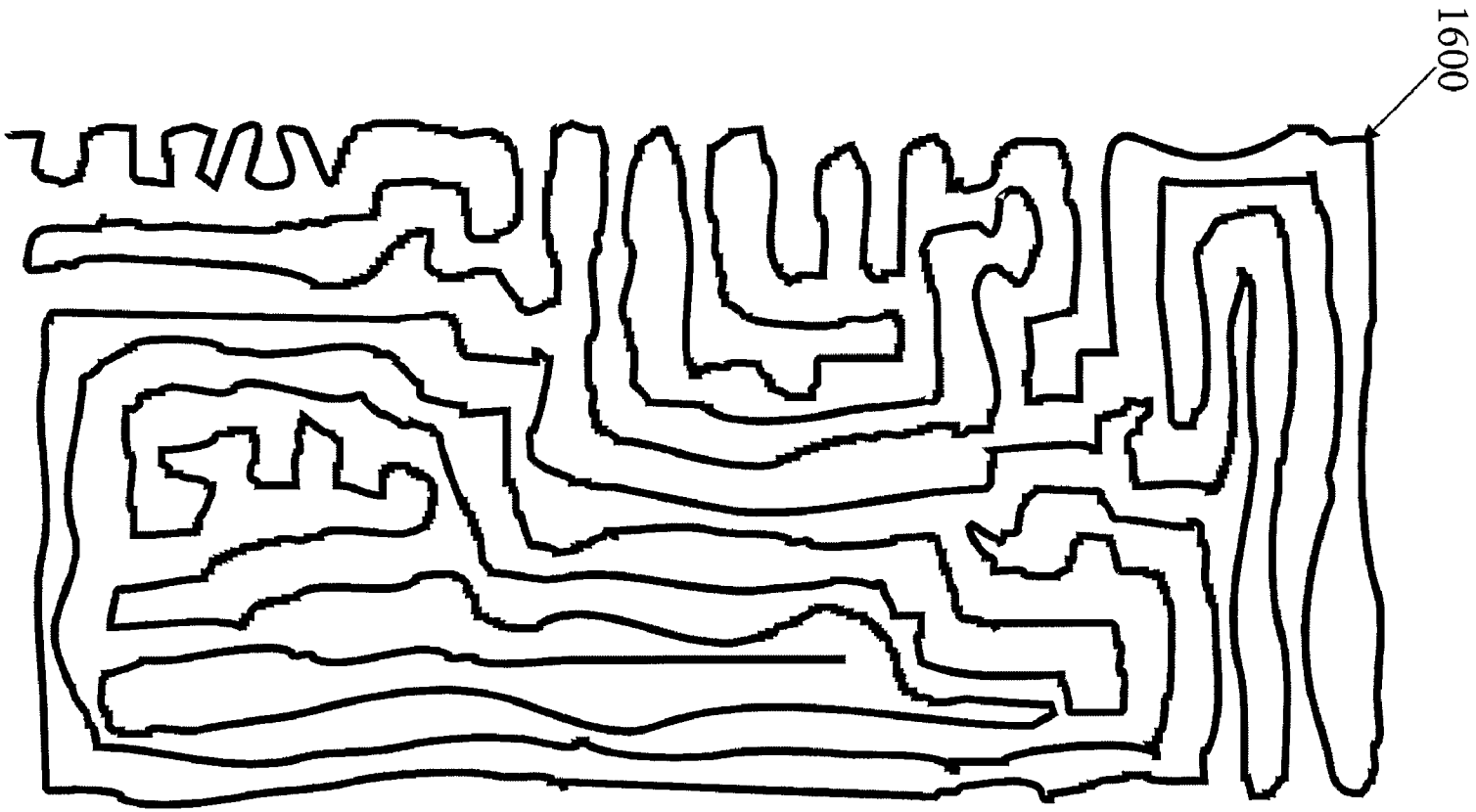
FIG. 12 shows an example of a space-filing curve.
Figure 13:
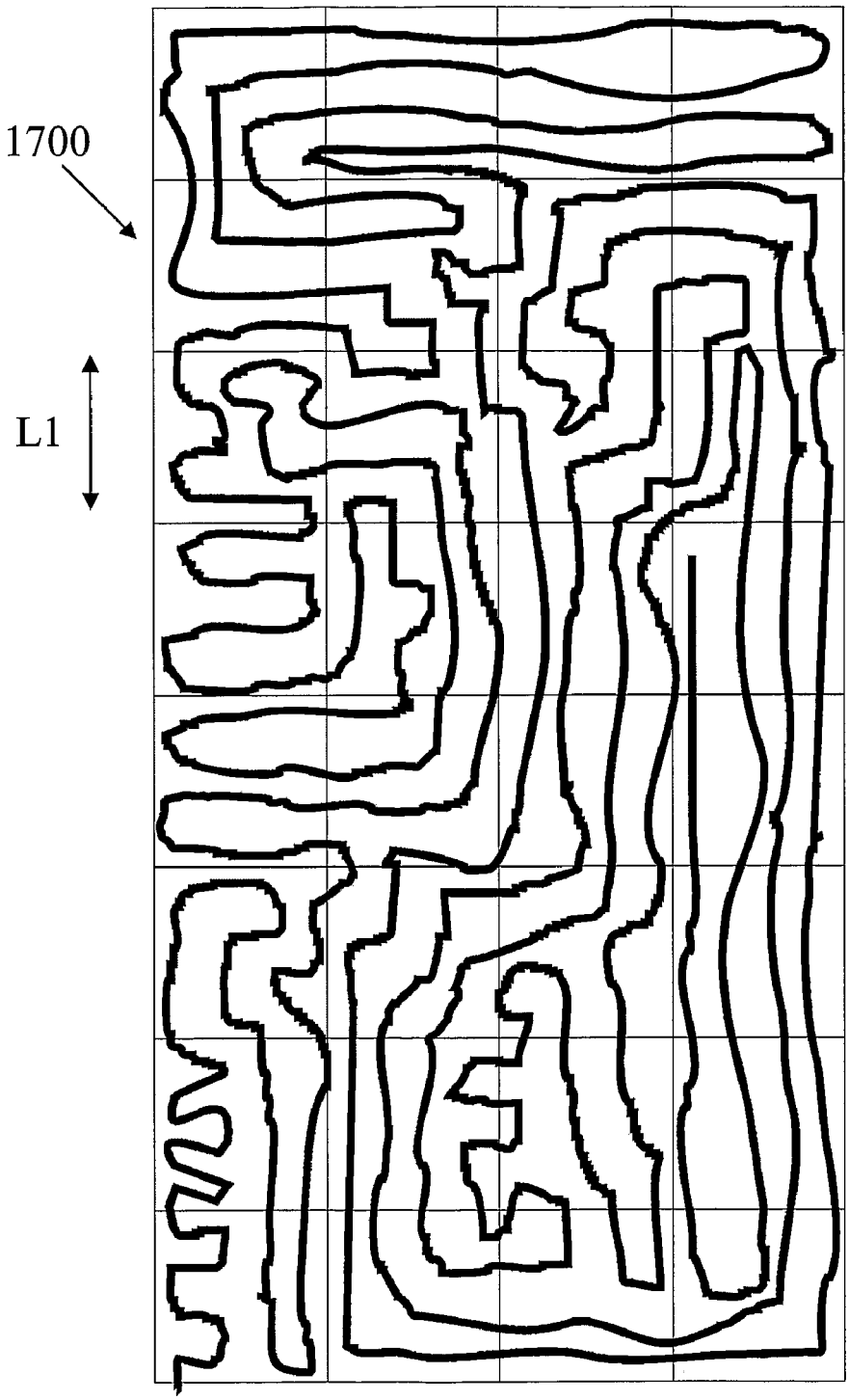
FIG. 13 shows a space-filling curve within a first grid.
Figure 14:
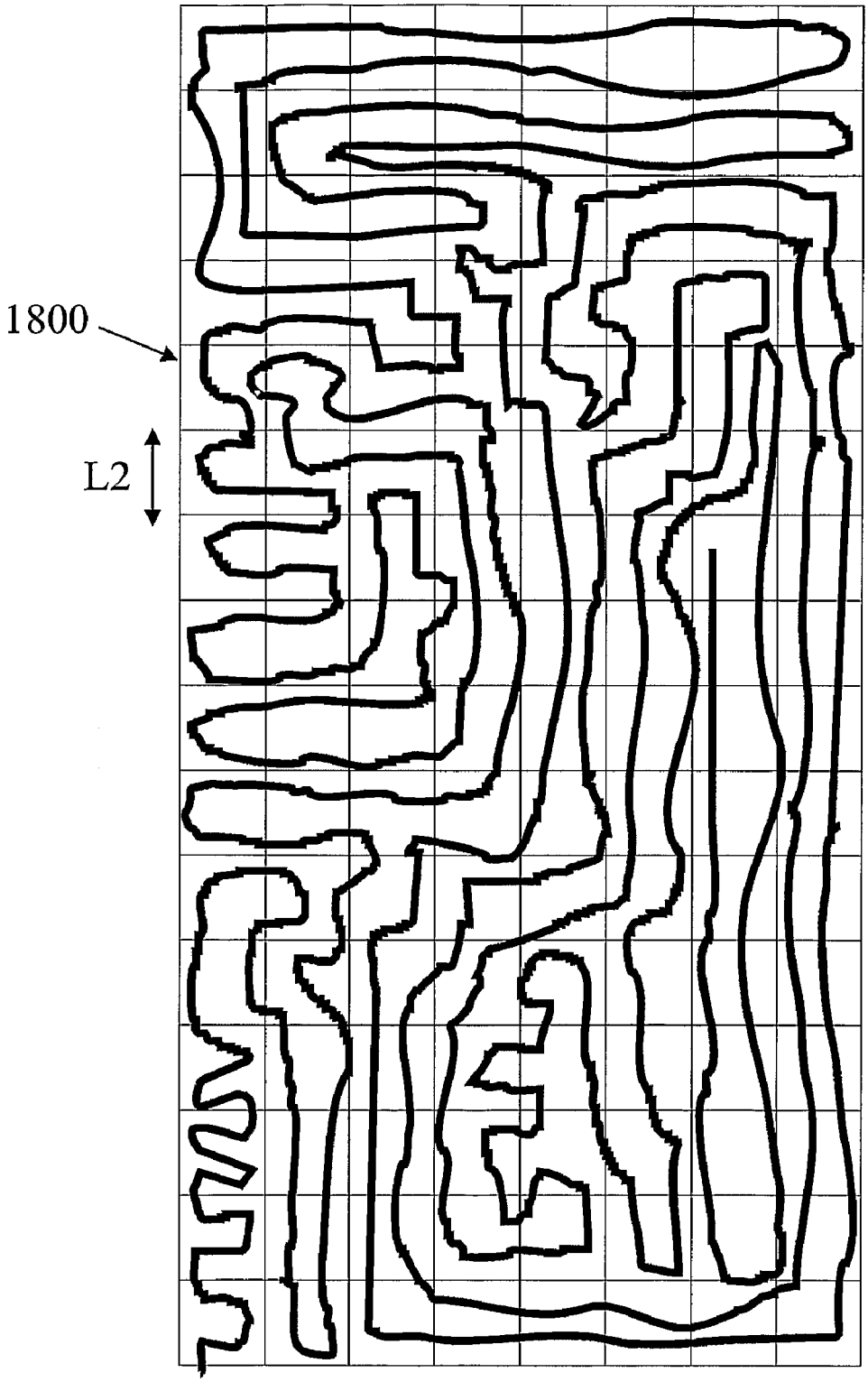
FIG. 14 shows a space-filling curve within a second grid.
Figure 15:
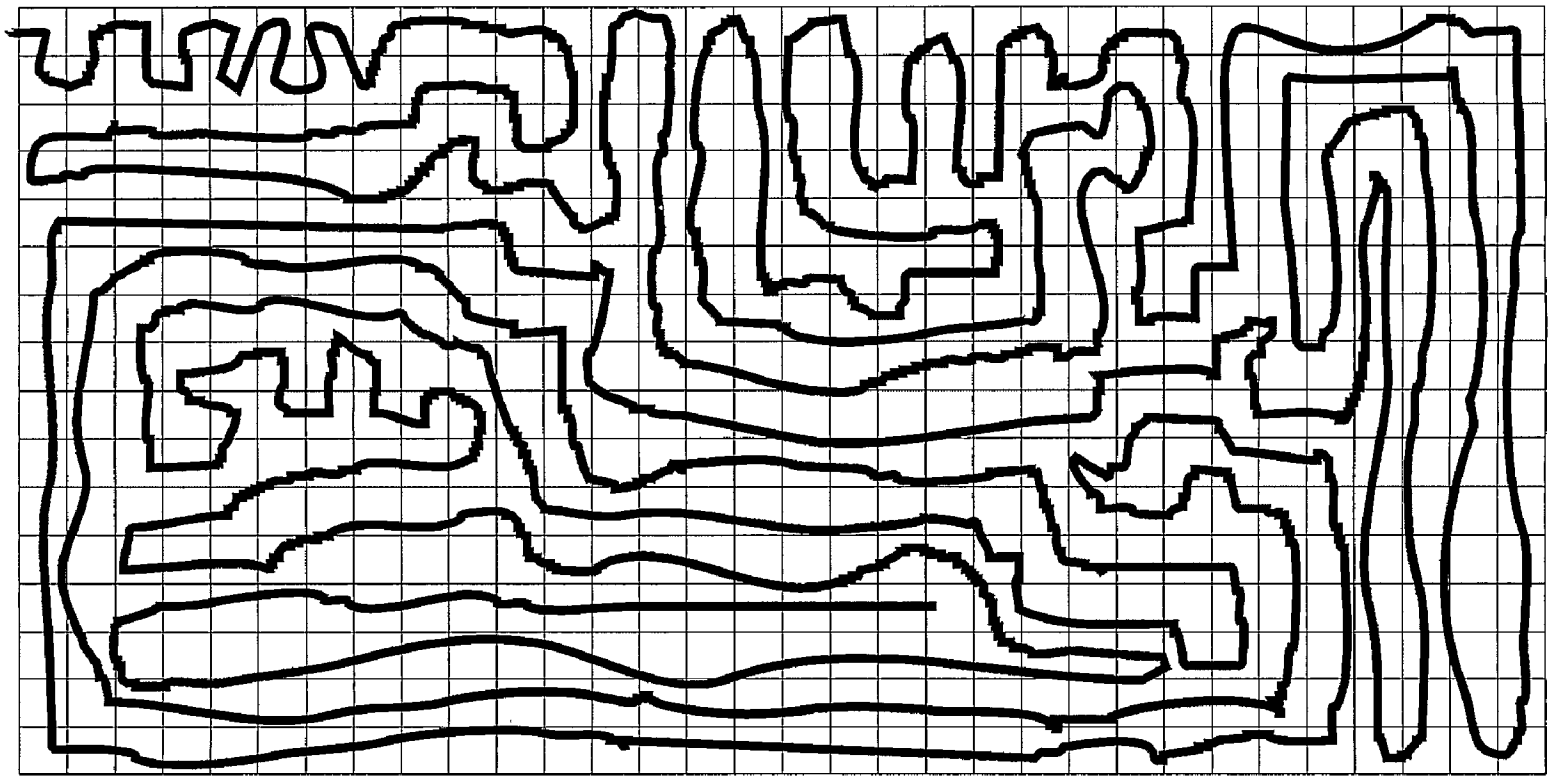
FIG. 15 shows a space-filling curve within a third grid.
Figure 16:
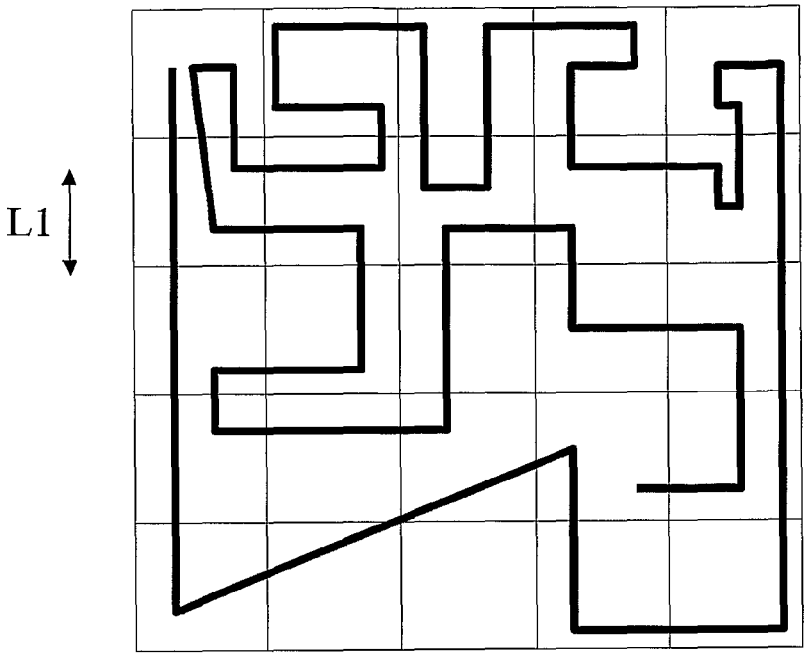
FIG. 16 shows a space-filling curve within a first box-counting grid.
Figure 17:
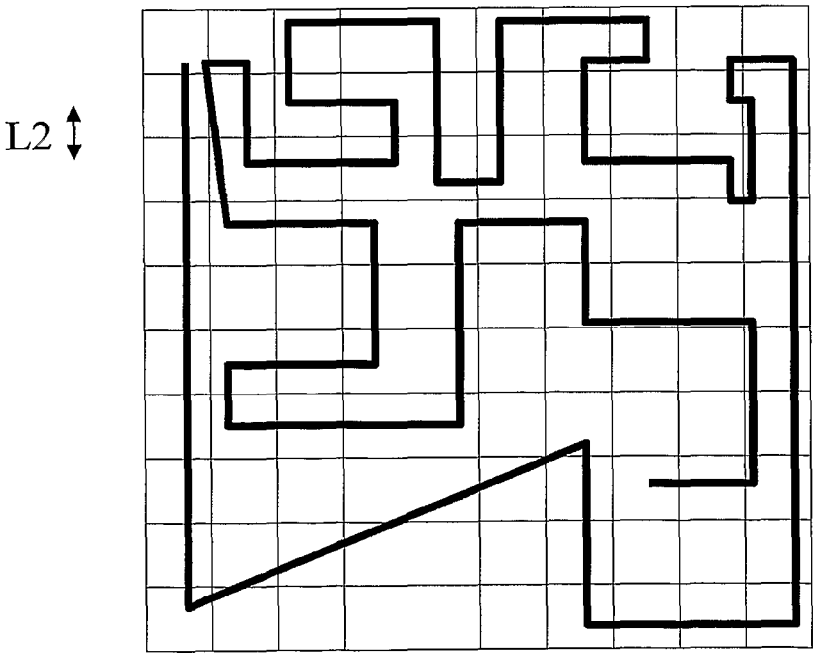
FIG. 17 shows a space-filling curve within a second box-counting grid.

The multiservice system antenna assembly of the present application can advantageously be located in the external rearview mirrors of motor vehicles, especially vans or trucks. FIG. 10 shows an example of such rearview mirrors. Important component of these mirrors are arm (16) (short, medium, long), mirror orientation system (17) (manual or electrical engine), and metallic bracket (14). One aspect of the present invention refers to a vehicle including the multiservice system antenna assembly.

The antenna could be advantageously be integrated in the right mirror for left side driving. It can also be positioned in the left mirror for right-side driving. From mechanical or electrical point of view, the antenna could have been also integrated in the other side mirror. This features a high level of standardization, offering the capacity of antenna installation independently from the car structure: low roof or high roof vans, passenger vans, camping-caravanning vans, special vans (ambulance, police, and fire brigade), etc . . . For all these vehicles, the external mirror is kept the same. In this manner, the car manufacturer does not have worry any more about antenna installation.

Among all the possible embodiments of the invention, several example arrangements include:

Radio service alone

Radio plus telephone

Radio plus telephone plus GPS

Other combinations of services may include:

Telephone standalone

Telephone plus GPS

GPS standalone

Figure 3:
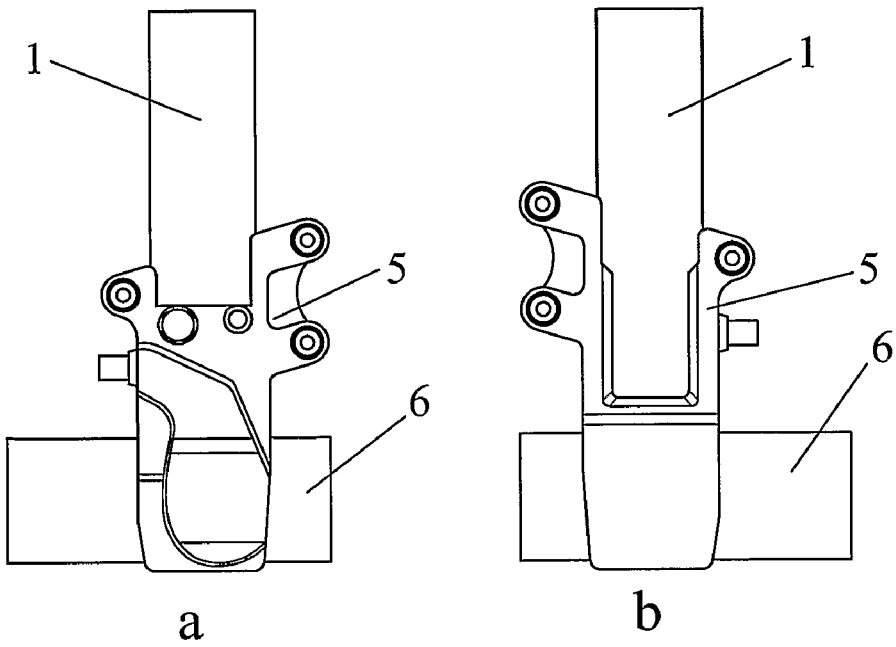
FIG. 3 shows in FIG. 3*a* a front view and in FIG. 3*b* a rear view of the multiservice antenna system assembly when both the radio antenna and the telephony antenna are present.
Figure 4:
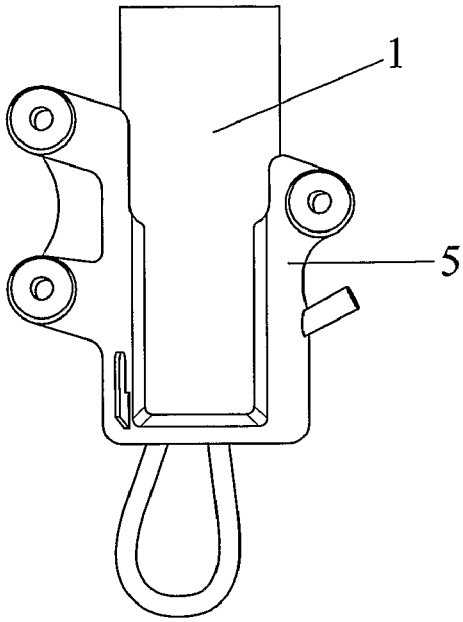
FIG. 4 shows a rear view of the multiservice antenna system assembly when only the radio antenna is used.

Other services (DAB, DTB, PCS1900, KPCS, CDMA, WCDMA, TDMA, UMTS, TACS, ETACS, SDARS, WiFi, WiMAX, UWB, Bluetooth, ZigBee) could be also integrated in the same way. Two over-molded shapes for the support member (5) have been design to take into account the two main options. One short support member (5) as shown in FIG. 4 for only radio antenna, and a longer support member as shown in FIG. 3 to support a radio antenna and a telephony antenna. Morevover, the support member (5) is designed to support the radio antenna of the first PCB (1) inside the mirror assembly (15) and to ensure waterproof protection. This part is mounted on the metallic internal bracket (14).

Figure 5:
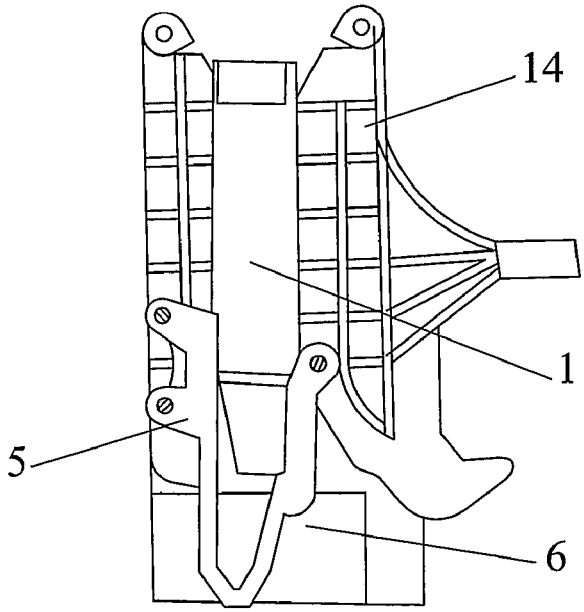
FIG. 5 shows a front view of the multiservice antenna system assembly mounted on a metallic bracket of a rear view mirror assembly.
Figure 6:
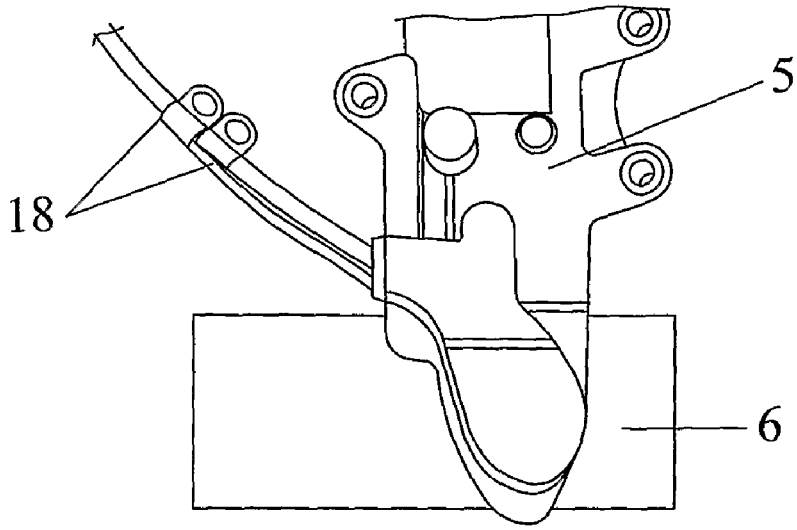
FIG. 6 shows in FIG. 6*a* a detailed view of the lower front part of the multiservice antenna system assembly, and in FIG. 6*b* a detailed view of the lower rear part of the same assembly.
Figure 6:
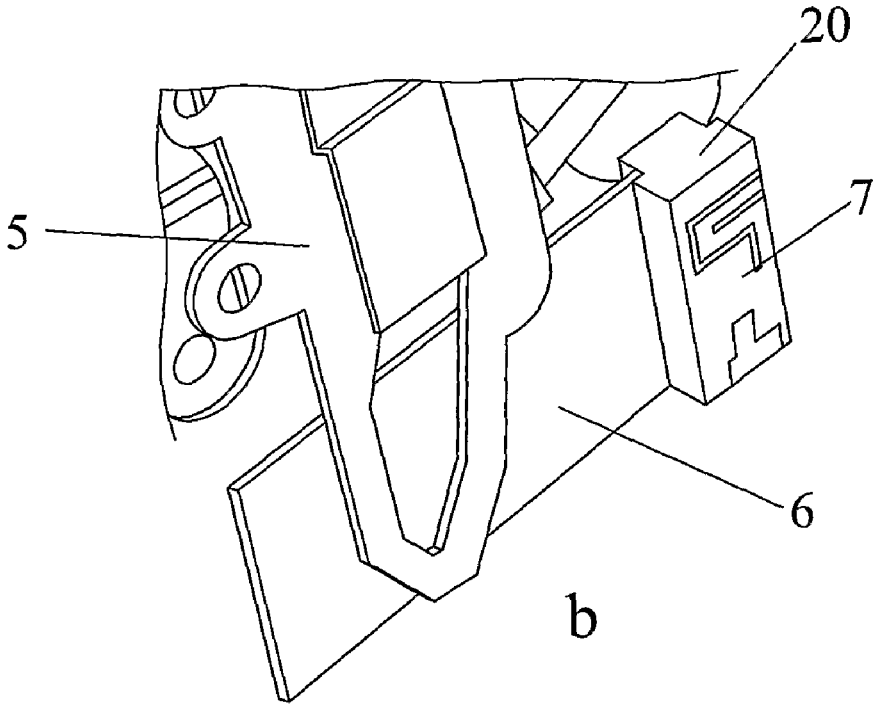

This metallic bracket (14), represented in FIGS. 5 and 6, original function is to support the electrical engines and glasses. When the multiservice antenna system assembly is integrated, these parts are used for:

Antennas (GPS, FM and GSM) support to fix them.

LW&MW and FM antennas protection against interferences radiated by thermal and motor wires.

Ground the radio, Telephone and GPS cables to reduce interferences. For this, a specific connector (18) has to be added on the each output coaxial cables (2, 8 and 11). This connector is directly gripped on the coaxial and screw to the bracket (14).

In a non limitative way some advantageous arrangements in the design of the FM antenna could be:

The printed circuit board are in parallel.

The material chosen for the PCB is FR-4 type in this case. Any dielectric material (hard or flexible) including a conductive layer could also selected to be the physical support of the antenna and the active system.

Relative separation between the first printed circuit board (1) and metallic bracket (14) should be small.

It is preferable that the plastic over-molded material not to be present over the FM antenna itself part of the PCB to avoid losses or antenna resonance shifting.

The AM reception may be achieved by a specific cable (4) separated from the rest of the radio antenna. The cable physical parameters and routing can be optimized to adapt the multiservice antenna assembly to a mirror, to optimize the reception and minimize the interferences due to the electrical parts of the mirror (electrical engines in particular). It is advantageous that the AM route follows the orientation as represented in FIG. 7, that is, it is placed around the edge of the first printed circuit board (1), however other orientations may be used.

Figure 8:
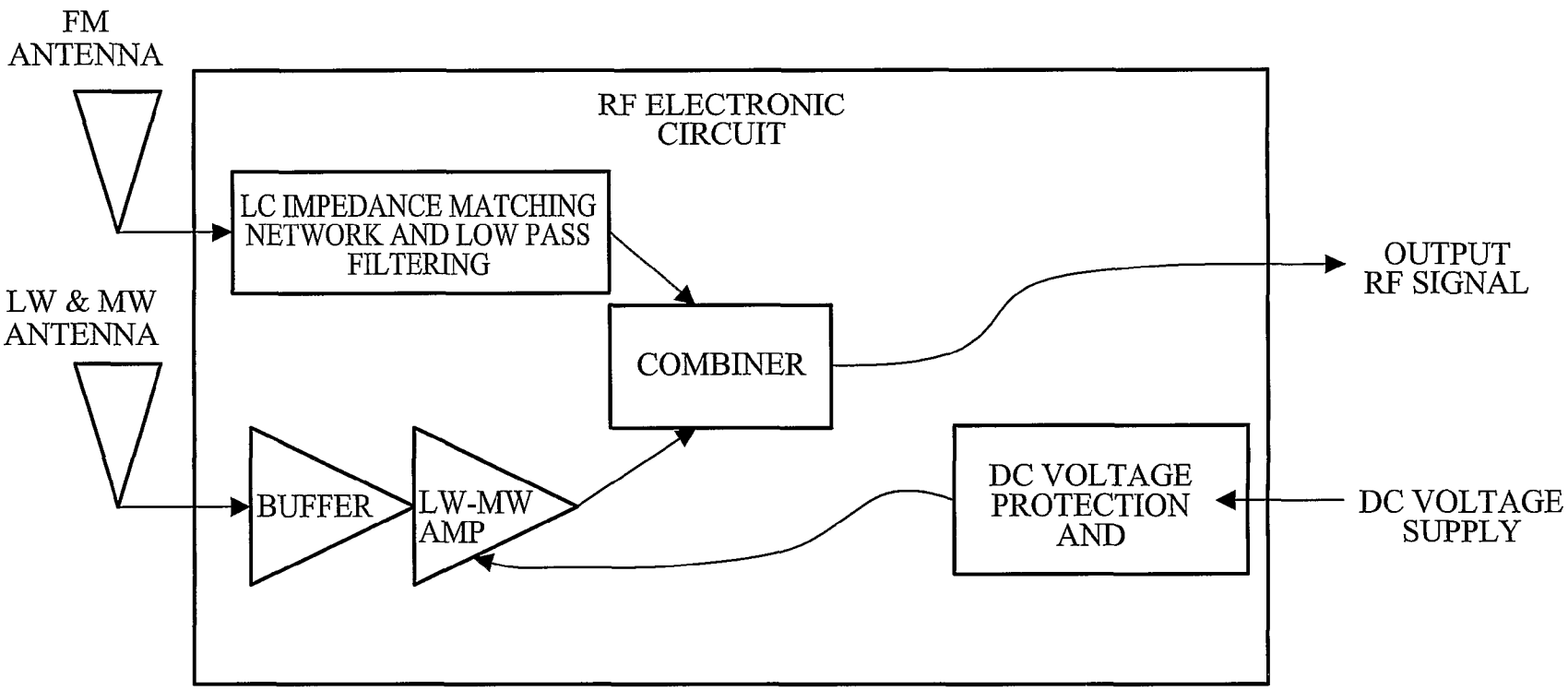
FIG. 8 shows a electric diagram of the radio frequency electronic circuit.
Figure 9:
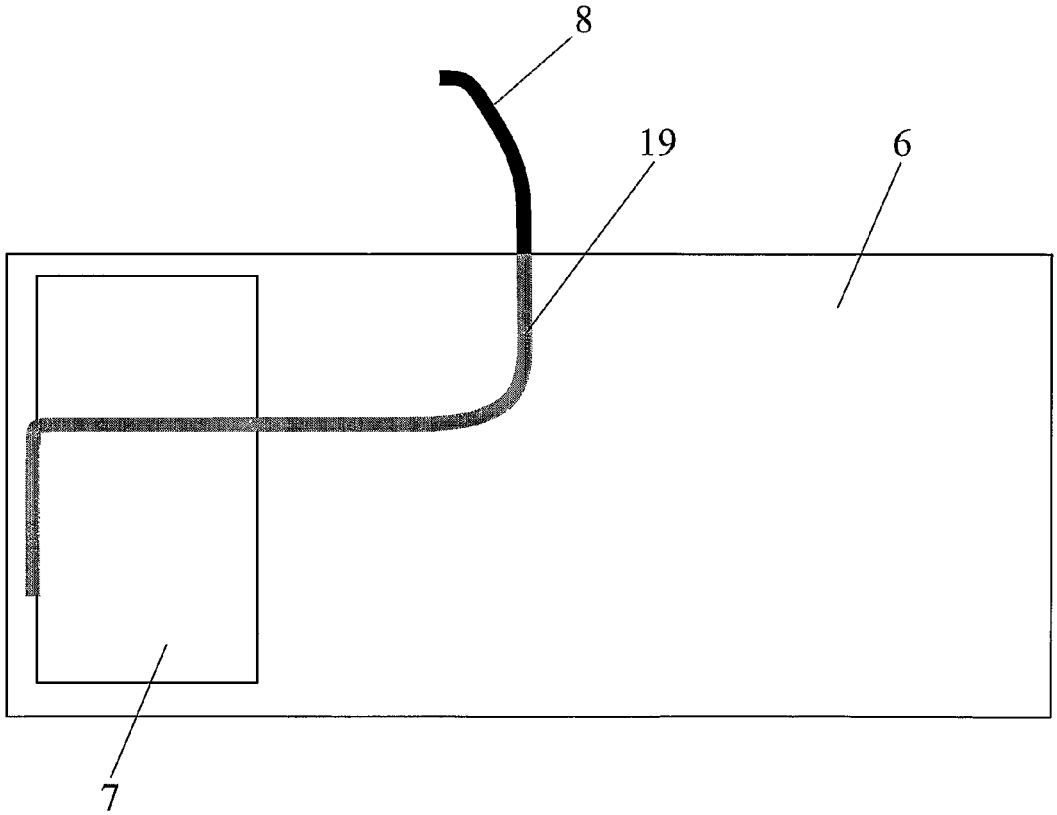
FIG. 9 shows a schematic representation of the telephone antenna configuration.

An active system (13) in AM can be introduced in order to match the antenna output impedance with the radio input impedance. Also, the active system (13) can be designed to reduce interferences in AM. The introduction of an active system (13), which is shown in FIG. 8, is convenient to optimize the energy transfer received by the LW/MW antenna to the radio input. In FM, no amplification is introduced, only an optimization of the impedance matching between FM antenna and radio input. However, the FM amplification could be easily introduced under requirements without modifying the system configuration. The AM impedance adaptation is realized by a buffer. An additional active stage of the buffer is incorporated to minimize the interferences due to other.

Figure 7:
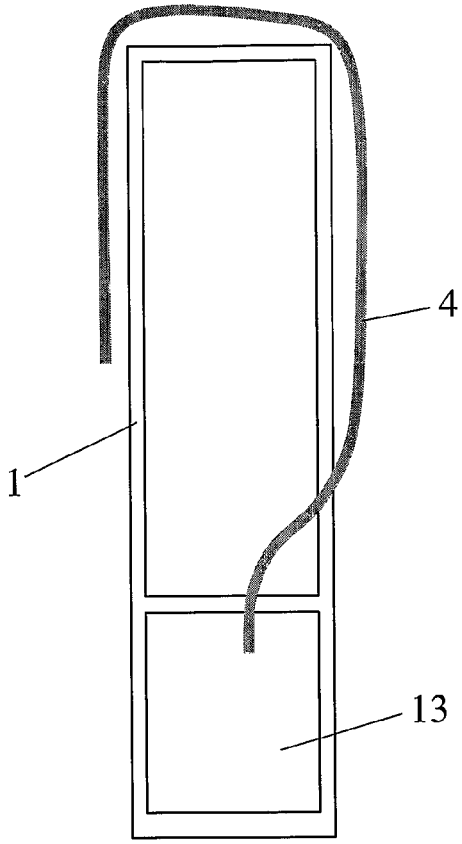
FIG. 7 shows in FIG. 7*a* a schematic front view of the AM/FM antenna, and in FIG. 7*b* a detailed front view of the same antenna.
Figure 7:
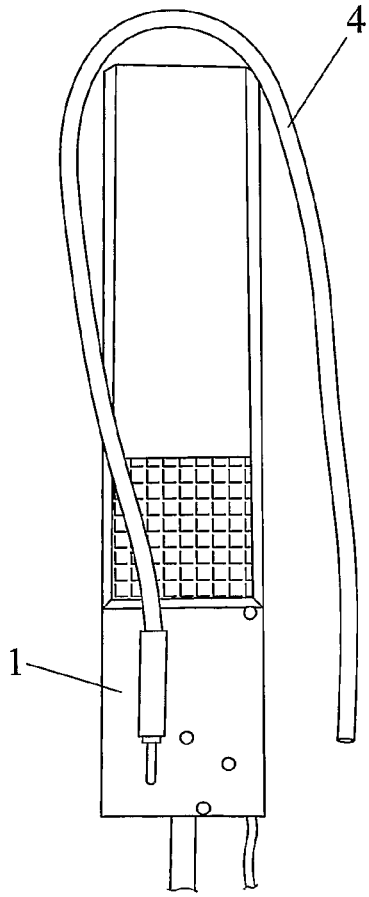

FIG. 7 represents a possible arrangement of the telephone antenna configuration. The second (PCB) printed circuit board (8) in which the antenna is mounted fulfills among others several tasks:

The second (PCB) printed circuit board (8) or telephone PCB is used for:

Support the antenna (7)

Match the antenna impedance to 50 ohms through a microstrip line (19).

Improve the antenna efficiency by the introduction of fractal shape in the PCB Ground the antenna.

The material chosen for the PCB is FR-4 type in this case. Any dielectric material (hard or flexible) including a conductive layer could also selected to be the physical support of the antenna and the active system.

Furthermore, the telephone antenna (7) is composed by two elements:

Plastic support (20): function of roughness and support to the antenna metallic element.

Antenna metallic element: design to be resonating at least in the GSM900 and GSM1800 bands. The antenna geometrical shape is based on the meander techniques in order to improve the antenna parameters and reduce its size. Additional telephony bands could be also introduced, as a way of example (AMPS, PCS, UMTS, Japanses standards) using the same configuration Regarding the placement of the GSM antenna, the following features are preferred that the relative position of the second PCB (6) (telephone PCB) with respect to the first PCB (1) (radio PCB), as shown in FIGS. 5 and 6 for instance, should be coplanar or at least parallel. If integrated in the same plane, then the same PCB could support the space-filling or grid dimension antenna and its related the active system and the telephone antenna PCB. A ground connector (18) is required on the output RF cable (8) to reduce interferences. This connector (18) is gripped on the output coaxial cable and screw to the bracket (14).

The GPS antenna (9) (FIG. 10) is a standalone microstrip patch including preferably a pre-amplifier electronic and waterproof packaging. The GPS antenna (9) could be fixed on the mirror bracket (14) superior part on the top of an additional ground plane to improve GPS reception performance.

A GND connection in the signal cable should be present in order to avoid interferences due to GND differential voltage levels in LW and MW bands: A ground connector (18) is integrated on the output RF cable (11) to reduce interferences. This connector is gripped on the output coaxial cable and screw to the bracket (14).

Further embodiments of the invention are described in the attached dependent claims.

The invention is obviously not limited to the specific embodiment(s) described herein, but also encompasses any variations that may be considered by any person skilled in the art (for example, as regards the choice of materials, dimensions, components, configuration, etc.), within the general scope of the invention as defined in the claims.

The invention claimed is:

1. A multiservice antenna system assembly comprising:

at least a first printed circuit board and a second printed circuit board, each of said first and second printed circuit boards comprising at least one antenna, and a support member made of a plastic material and configured to be mounted inside a rearview mirror of a motor vehicle, wherein said at least first and second printed circuit boards are supported by said support member, and lie in substantially parallel planes, wherein said at least one antenna on said first printed circuit board is disposed on a face of the first printed circuit board and comprises a radio FM antenna shaped as a space-filling curve, wherein said at least one antenna on said second printed circuit board is disposed on a face of the second printed circuit board and comprises a telephone antenna, wherein at least said first printed circuit board further comprises at least one electronic component, and wherein said support member is overmolded over said first printed circuit board and over said at least one electronic component, so that said first printed circuit board is at least partially embedded within said support member.

2. The multiservice antenna system assembly according to claim 1 wherein said space-filling curve has a box-counting dimension larger than 1.5 or a grid dimension larger than 1.5.

3. The multiservice antenna system assembly according to claim 1 or 2, wherein said space-filling curve is substantially a Hilbert curve.

4. The multiservice antenna system assembly according to claim 1, which provides at least one communication or positioning services selected from a group consisting of: i) a radio communication service, ii) a telephone communication service, iii) a GPS positioning service.

5. The multiservice antenna system assembly according to claim 1, which provides a communication service selected from a group consisting of: DTB, PCS1900, KPCS, CDMA, WCDMA, TDMA, UMTS, TACS, ETACS, SDARS, WiFi, WiMAX, UWB, Bluetooth, and ZigBee.

6. The multiservice antenna system assembly according to claim 1, wherein said telephone antenna is a GSM dual band antenna or a multiband antenna for cellular telephony.

7. A rear-view mirror assembly for a motor vehicle, comprising the multiservice antenna system assembly according to claim 1.

8. The rear-view mirror assembly according to claim 7 wherein said support member is housed within the rear-view mirror assembly.

9. The rear-view mirror assembly according to claim 7 or claim 8 further comprising a GPS antenna.

10. The rear-view mirror assembly according to claim 9 wherein said GPS antenna is a microstrip patch antenna.

11. The rear-view mirror assembly according to claim 7, wherein the multiservice antenna system assembly is mounted on a metallic internal bracket of said mirror assembly.

12. The rear-view mirror assembly according to claim 11, further comprising a GPS antenna housed within a waterproof package, wherein said package is fixed to the metallic internal bracket of said mirror assembly.

13. The rear-view mirror assembly according to claim 7, which is an external rear-view mirror assembly.

14. A vehicle comprising a rear-view mirror assembly according to claim 7.

* * * * *